US009551958B2

(12) United States Patent
Mandai et al.

(10) Patent No.: US 9,551,958 B2
(45) Date of Patent: Jan. 24, 2017

(54) DEVELOPING APPARATUS HAVING RECYCLING PATHS FOR RECYCLING OF TONER AND IMAGE FORMING APPARATUS INCLUDING THE SAME

(71) Applicant: KONICA MINOLTA, INC., Chiyoda-ku, Tokyo (JP)

(72) Inventors: Yuusuke Mandai, Kyoto (JP); Yasuyuki Inada, Toyohashi (JP); Shinji Ogawa, Toyokawa (JP); Masato Kimura, Toyoake (JP); Yu Mukobayashi, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/694,444

(22) Filed: Apr. 23, 2015

(65) Prior Publication Data

US 2015/0323886 A1 Nov. 12, 2015

(30) Foreign Application Priority Data

May 12, 2014 (JP) ..... 2014-098800

(51) Int. Cl.
*G03G 21/10* (2006.01)
*G03G 15/08* (2006.01)

(52) U.S. Cl.
CPC ..... *G03G 15/0893* (2013.01); *G03G 15/0891* (2013.01); *G03G 21/10* (2013.01);
(Continued)

(58) Field of Classification Search
CPC ..... G03G 15/0891; G03G 21/10; G03G 2215/0607; G03G 2215/0802; G03G 2215/0819; G03G 15/0893; G03G 2215/0838
See application file for complete search history.

(56) References Cited

U.S. PATENT DOCUMENTS 8,818,245 B2 8/2014 Takaya et al.
2008/0199223 A1 8/2008 Tateyama et al.
(Continued)

FOREIGN PATENT DOCUMENTS

JP 2007272201 A 10/2007
JP 2009036787 A 2/2009
(Continued)

OTHER PUBLICATIONS

Japanese Office Action (and English translation thereof) dated Aug. 19, 2016, issued in counterpart Japanese Application No. 2014-098800.

*Primary Examiner* — David Gray
*Assistant Examiner* — Laura Roth
(74) *Attorney, Agent, or Firm* — Holtz, Holtz & Volek PC

(57) ABSTRACT

A developing apparatus that develops an electrostatic latent image on an image supporting body using developer including toner and carrier includes a circulation path where the developer circulates, a discharge path connected to the circulation path through which some of the developer passes, and a first recycle path connected to the discharge path and allowing some of the developer flowing into the discharge path to return to the circulation path. The discharge path includes a discharge opening for discharging the developer flowing into the discharge path, and a first return opening for connecting to the first recycle path. The first return opening is located on an upper side in a vertical direction with respect to the discharge opening and located on an upstream side in a pass-through direction of the developer flowing into the discharge path.

15 Claims, 6 Drawing Sheets

(52) U.S. Cl.
CPC ..... *G03G 2215/0607* (2013.01); *G03G 2215/0819* (2013.01)

(56) References Cited

U.S. PATENT DOCUMENTS

| | | | | |
|---|---|---|---|---|
| 2011/0194863 | A1* | 8/2011 | Matsumoto ..... | G03G 15/0822 399/27 |
| 2012/0189349 | A1 | 7/2012 | Okuno et al. | |

FOREIGN PATENT DOCUMENTS

| | | | |
|---|---|---|---|
| JP | 2010044381 | A | 2/2010 |
| JP | 2010217501 | A | 9/2010 |
| JP | 2011197442 | A | 10/2011 |
| JP | 2012150316 | A | 8/2012 |

* cited by examiner

DEVELOPING APPARATUS HAVING RECYCLING PATHS FOR RECYCLING OF TONER AND IMAGE FORMING APPARATUS INCLUDING THE SAME

The entire disclosure of Japanese Patent Application No. 2014-098800 filed on May 12, 2014 including description, claims, drawings, and abstract are incorporated herein by reference in its entirety.

BACKGROUND OF THE INVENTION

1. Field of the Invention

The present invention relates to a developing apparatus and an image forming apparatus and more particularly to a developing apparatus that develops an electrostatic latent image on an image supporting body, using developer including toner and carrier, and an image forming apparatus including the developing apparatus.

2. Description of the Related Art

Conventionally, for a developing apparatus mounted on an image forming apparatus of an electrophotographic system, there is known a developing apparatus that develops an electrostatic latent image formed on a photoconductor, using two-component developer including carrier and toner. In recent years, there has been proposed a developing apparatus of a system called a trickle system in which developer including toner in which a small amount of carrier is mixed is replenished in a developing bath according to the amount of toner consumed, and a certain amount of developer accumulated in the developing bath is discharged.

Meanwhile, to discharge a certain amount of developer, in the developing apparatus of the trickle system, like a developing apparatus described in JP 2010-217501 A, a discharge path where a certain amount of developer is discharged is provided and a discharge opening for discharging the certain amount of developer is provided in the discharge path. However, when the developing apparatus is tilted more than expected and accordingly excess developer flows into the discharge path, even essentially necessary developer is discharged through the discharge opening. As a result, there are problems such as the occurrence of uneven density in a developed image.

SUMMARY OF THE INVENTION

An object of the present invention is to provide a developing apparatus capable of suppressing the occurrence of uneven density in a developed image by maintaining an appropriate amount of developer in a developing bath, and an image forming apparatus including the developing apparatus.

To achieve the abovementioned object, according to an aspect, a developing apparatus that develops an electrostatic latent image on an image supporting body, using developer including toner and carrier, the developing apparatus reflecting one aspect of the present invention comprises: a circulation path where the developer circulates; a discharge path which is connected to the circulation path and through which some of the developer passes; and a first recycle path connected to the discharge path and allowing some of the developer flowing into the discharge path to return to the circulation path, wherein the discharge path is provided with: a discharge opening for discharging the developer flowing into the discharge path; and a first return opening for connecting to the first recycle path, and the first return opening is located on an upper side in a vertical direction with respect to the discharge opening and located on an upstream side in a pass-through direction of the developer flowing into the discharge path.

According to another aspect of the present invention, an image forming apparatus preferably includes the developing apparatus.

In the developing apparatus according to the aspect of the present invention, the first return opening that allows developer to return to the circulation path is located on the upper side in the vertical direction with respect to the discharge opening through which the developer is discharged. At normal times, developer passes through an area more on the lower side in the vertical direction than the first return opening and thus does not return to the circulation path through the first return opening. Meanwhile, the discharge opening is present more on the lower side than the first return opening, i.e., at a position where the developer passes through. Thus, a certain amount of developer is discharged through the discharge opening, and accordingly, an appropriate amount of developer is maintained in the circulation path. In addition, the first return opening is located on the upstream side in the pass-through direction of the developer with respect to the discharge opening. By this, when excess developer flows into the discharge path, some of the developer returns to the circulation path through the first return opening before the developer is discharged through the discharge opening. Therefore, essentially necessary developer is suppressed from being discharged from the developing bath. By the above, the developing apparatus according to the aspect can suppress the occurrence of uneven density in a developed image by maintaining an appropriate amount of developer in the developing bath.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

Figure 1:
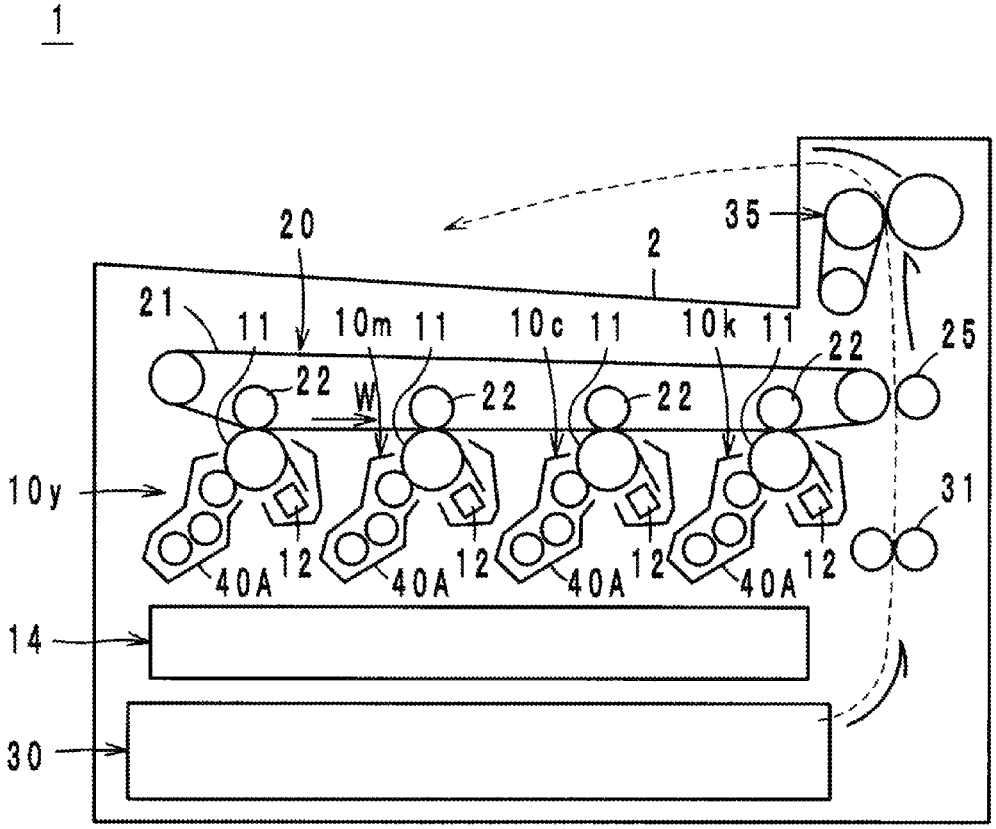
FIG. 1 is a schematic diagram showing an internal structure of an image forming apparatus.

(Schematic Configuration of an Image Forming Apparatus, See FIG. 1)

A developing apparatus which is a first embodiment and an embodiment of an image forming apparatus including the developing apparatus will be described below with reference to the accompanying drawings. In the drawings, the same members and portions are denoted by common reference sings and overlapping description is omitted.

An image forming apparatus 1 shown in FIG. 1 is an electrophotographic printer of a tandem system, and includes imaging units 10 (10*y*, 10*m*, 10*c*, and 10*k*) for forming a toner image of each of Y (yellow), M (magenta), C (cyan), and K (black) colors; and an intermediate transfer unit 20.

Each imaging unit 10 has an electrostatic charger 12, a developing apparatus 40A, and the like, which are disposed around a photoconductor drum 11. The developing apparatus 40A develops an electrostatic latent image which is drawn on the photoconductor drum 11 by light irradiated from a laser scanning optical unit 14, and thereby forms a toner image of a corresponding color. The intermediate transfer unit 20 includes an intermediate transfer belt 21 which is endlessly and rotatingly driven in a direction of arrow W. The intermediate transfer unit 20 performs primary transfer of the toner images formed on each photoconductor drum 11, onto the intermediate transfer belt 21 by electric fields provided from primary transfer rollers 22 facing their corresponding photoconductor drums 11, to combine the toner images. Note that such an image forming process by an electrophotographic method is a known process and thus a detailed description thereof is omitted.

An automatic paper feeding unit 30 that feeds materials on which transfer is performed (hereinafter, referred to as paper) one by one is disposed at the bottom of a main body of the apparatus 1. The paper passes through a pair of timing rollers 31 from a paper feed roller (not shown) and is then transported to a nip portion between the intermediate transfer belt 21 and a secondary transfer roller 25. Then, secondary transfer of the toner image (combined color image) is performed on the paper by an electric field provided from the secondary transfer roller 25. Thereafter, the paper is transported to a fusing unit 35 to heat and fuse the toner, and is discharged onto a tray portion 2 disposed at the top of the main body of the apparatus 1.

Figure 2:
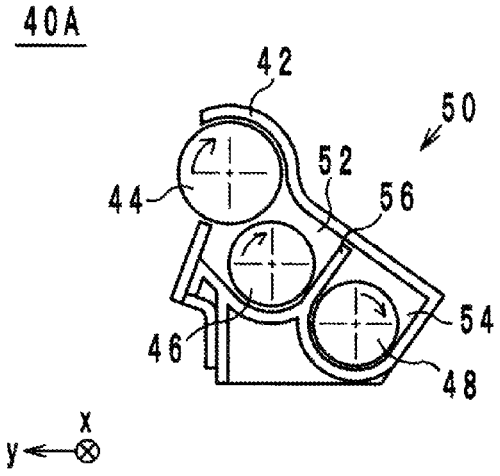
FIG. 2 is a cross-sectional view of a portion of a developing apparatus according to a first embodiment around a developing roller, when viewed from a direction parallel to a central axis of a supply screw included in the developing apparatus.
Figure 3:
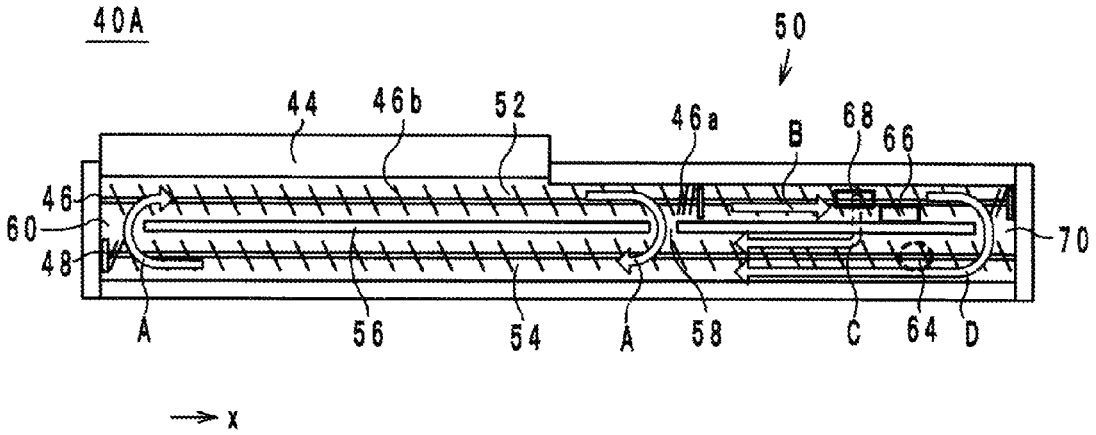
FIG. 3 is a cross-sectional view of the developing apparatus according to the first embodiment when viewed from a direction orthogonal to the central axis of the supply screw included in the developing apparatus.
Figure 4:
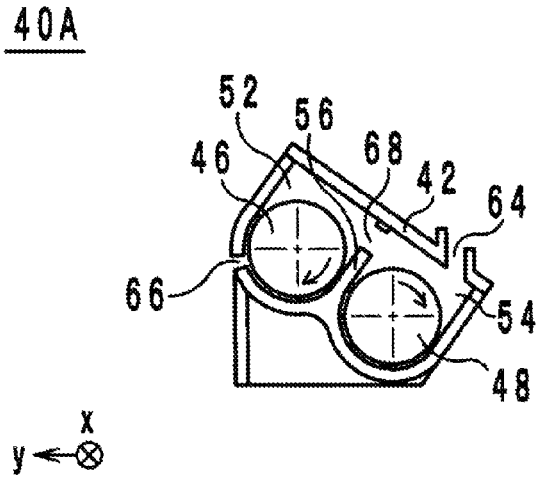
FIG. 4 is a diagram in which cross-sections of a replenishing opening and a return opening are added to a cross-sectional view of a portion of the developing apparatus according to the first embodiment around a discharge opening, when viewed from the direction parallel to the central axis of the supply screw included in the developing apparatus.

(Configuration of the Developing Apparatus, See FIGS. 2 to 4)

Each developing apparatus 40A which is the first embodiment uses two-component developer including carrier and toner. As shown in FIG. 2, the developing apparatus 40A has a developing roller 44, a supply screw 46, and a stirring screw 48 which are provided in a casing 42 in parallel with each other. Note that in the following a direction in which the developing roller 44, the supply screw 46, and the stirring screw 48 extend is defined as an x-axis direction. Note also that a direction orthogonal to the x-axis direction and to a vertical direction is defined as a y-axis direction.

The developing roller 44 forms a sleeve configuration including a magnet having a plurality of magnetic poles (not shown). The developing roller 44 is rotatingly driven with a slight space provided between the photoconductor drum 11 and the developing roller 44. A developing bath 50 is provided at the bottom of the developing roller 44. As shown in FIG. 3, the developing bath 50 is a container extending in the x-axis direction. In addition, the developing bath 50 is divided into two baths, a supply bath 52 and a stirring bath 54, by a separating wall 56 extending in the x-axis direction.

The supply bath 52 plays the role of supplying developer to the developing roller 44 and collecting developer remaining after the development. In addition, the supply screw 46 is provided in the supply bath 52. By rotation of the supply screw 46, the developer is transported to the positive direction side of the x-axis direction of the supply bath 52. Note that blades 46*a* near the center in the x-axis direction of the supply screw 46 are blades that are twisted in an opposite direction to that of blades 46*b* provided at other portions of the supply screw 46. Therefore, unless a pressure exerted by the developer in the supply bath 52 exceeds a predetermined value, there is no chance that the developer crosses the blades 46*a* and is transported to the positive direction side of the x-axis direction. Note that in the present embodiment in order to transport the developer from the negative direction side to positive direction side of the x-axis direction of the supply bath 52, the supply screw 46 rotates clockwise when viewed from the negative direction side of the x-axis direction.

The stirring bath 54 is adjacent, in parallel, to the supply bath 52 with the separating wall 56 therebetween, and stirs and mixes the developer. In addition, the stirring bath 54 is provided with the stirring screw 48. By rotation of the stirring screw 48, the developer is stirred and transported to the negative direction side of the x-axis direction of the stirring bath 54. Note that, as shown in FIG. 4, the stirring bath 54 is provided with a replenishing opening 64. New developer is replenished through the replenishing opening 64.

Here, as shown in FIG. 3, an opening 58 is provided at a position that is near the center in the x-axis direction of the separating wall 56 separating the supply bath 52 and the stirring bath 54 and that is more on the negative direction side of the x-axis direction than the blades 46*a*. Furthermore, an opening 60 is provided at an end of the separating wall 56 on the negative direction side of the x-axis direction. By this, developer transported to the positive direction side of the x-axis direction in the supply bath 52 passes through the opening 58 and enters the stirring bath 54. The developer entering the stirring bath 54 is transported, by the stirring screw 48, to the negative direction side of the x-axis direction and returns to the supply bath 52 through the opening 60. As such, the developer circulates through a section of the supply bath 52 from the opening 60 to the opening 58 and a section of the stirring bath 54 from the opening 58 to the opening 60. That is, the section of the supply bath 52 from the opening 60 to the opening 58 and the section of the stirring bath 54 from the opening 58 to the opening 60 form a circulation path A of the developer.

When the pressure exerted by the developer in the supply bath 52 exceeds the predetermined value, some of the developer transported within the supply bath 52 does not enter the stirring bath 54 through the opening 58, but crosses the blades 46*a* of the supply screw 46 and goes toward an end of the supply bath 52 on the positive direction side of the x-axis direction. Then, some of the developer going toward the end of the supply bath 52 on the positive direction side of the x-axis direction is discharged outside the developing apparatus 40A through a discharge opening 66 which is provided to discharge extra developer to refresh developer. That is, a portion of the supply bath 52 more on the positive direction side of the x-axis direction than the blades 46*a* forms a discharge path B through which the extra developer passes.

Meanwhile, the discharge path B is provided with a return opening 68 (first return opening). The return opening 68 is a hole for returning, when the developing apparatus 40A is tilted more than expected and accordingly excess developer flows into the discharge path B, some of the flowed developer to the circulation path A. The return opening 68 is provided, as shown in FIG. 4, on the upper side in the vertical direction with respect to the discharge opening 66 and is provided, as shown in FIG. 3, on the negative direction side of the x-axis direction with respect to the discharge opening 66 (the upstream side in the pass-through direction of the developer). In addition, the return opening 68 is disposed so as to be adjacent, in the x-axis direction, to the discharge opening 66.

The developer having passed through the return opening 68 enters the stirring bath 54 and is transported, by the stirring screw 48, to the negative direction side of the x-axis direction. As a result, the developer having passed through the return opening 68 gets back to the circulation path A from a portion of the stirring bath 54 near where the opening 58 is provided. That is, a section from the return opening 68 to the portion of the stirring bath 54 near where the opening 58 is provided forms a recycle path C (first recycle path) that allows the developer excessively flowing into the discharge path B to return to the circulation path A.

In addition, a return opening 70 (second return opening) is provided at an end of the discharge path B on the positive direction side of the x-axis direction, i.e., the end of the supply bath 52 on the positive direction side of the x-axis direction (the downstream side of the pass-through direction of the developer). The return opening 70 is to prevent developer having reached the end of the supply bath 52 on the positive direction side of the x-axis direction without discharged through the discharge opening 66, from being accumulated in the supply bath 52. Therefore, the return opening 70 is provided on the lower side in the vertical direction with respect to the discharge opening 66.

By this, the developer having passed through the return opening 70 enters the stirring bath 54 and is transported, by the stirring screw 48, to the negative direction side of the x-axis direction. As a result, the developer having passed through the return opening 70 gets back to the circulation path A from the portion of the stirring bath 54 near where the opening 58 is provided. That is, a section from the return opening 70 to the portion of the stirring bath 54 near where the opening 58 is provided forms a recycle path D (second recycle path) that allows the developer excessively flowing into the discharge path B to return to the circulation path A.

Effects

Figure 5:
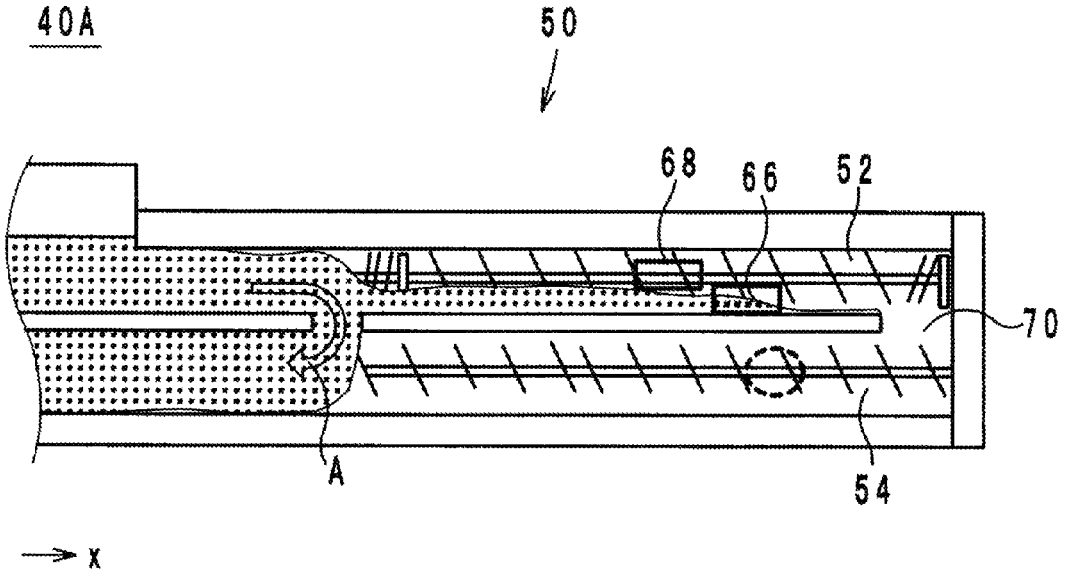
FIG. 5 is a cross-sectional view of the developing apparatus according to the first embodiment when viewed from the direction orthogonal to the central axis of the supply screw included in the developing apparatus, showing a normal state of developer circulation.
Figure 6:
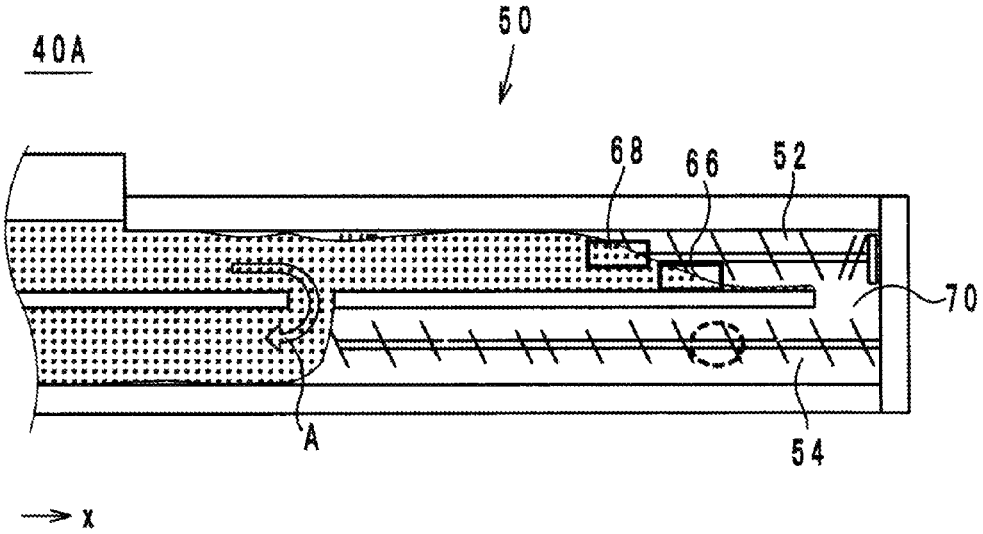
FIG. 6 is a cross-sectional view of the developing apparatus according to the first embodiment when viewed from the direction orthogonal to the central axis of the supply screw included in the developing apparatus, showing a state in which developer flows into a discharge path more than expected.

In the developing apparatuses 40A and the image forming apparatus 1 including the developing apparatuses 40A, the return opening 68 that allows developer to return to the circulation path A is located on the upper side in the vertical direction with respect to the discharge opening 66 through which developer is discharged. At normal times, as shown in FIG. 5, developer passes through an area more on the lower side in the vertical direction than the return opening 68 and thus does not return to the circulation path A through the return opening 68. Meanwhile, the discharge opening 66 is present more on the lower side in the vertical direction than the return opening 68, i.e., at a position where the developer passes through. Thus, a certain amount of developer is discharged through the discharge opening 66, and accordingly, an appropriate amount of developer is maintained in the circulation path A. In addition, the return opening 68 is located on the upstream side in the pass-through direction of the developer with respect to the discharge opening 66. Therefore, as shown in FIG. 6, when excess developer flows into the discharge path B, some of the developer returns to the circulation path A through the return opening 68 before the developer is discharged through the discharge opening 66. By this, essentially necessary developer is suppressed from being discharged from the developing bath 50. By the above, the developing apparatuses 40A and the image forming apparatus 1 including the developing apparatuses 40A can suppress the occurrence of uneven density in a developed image by maintaining an appropriate amount of developer in each developing bath 50.

Figure 7:
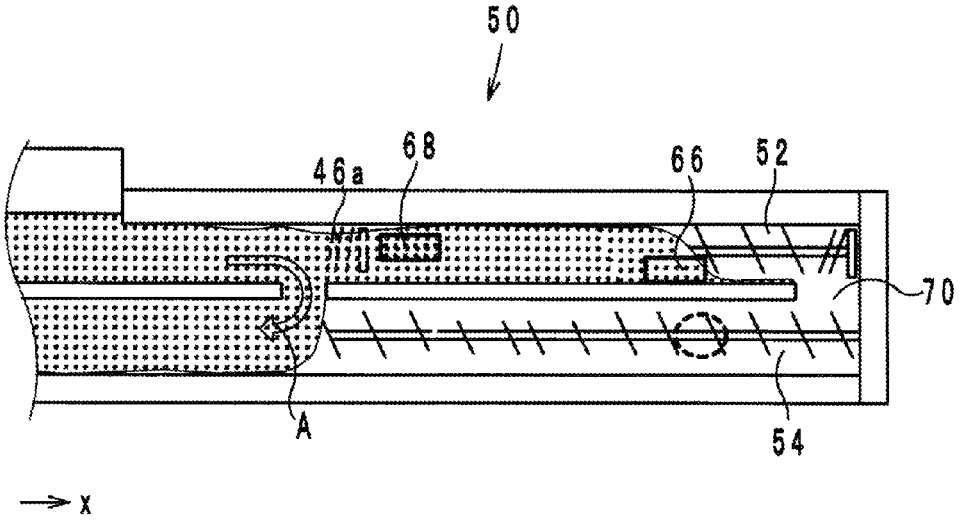
FIG. 7 is a cross-sectional view of a developing apparatus in which disposition of a return opening is changed from that of the developing apparatus according to the first embodiment, when viewed from a direction orthogonal to a central axis of a supply screw included in the developing apparatus.

Meanwhile, when, as shown in FIG. 7, the return opening 68 is provided on the upstream side with respect to the discharge opening 66, i.e., provided on the negative direction side of the x-axis direction so as to be away from the discharge opening 66, if the image forming apparatus 1 is tilted upon its installation and accordingly a large amount of developer is present in the discharge path B, most of the developer is located more on the downstream side than the return opening 68. When in this state the image forming apparatus 1 starts up and the supply screw 46 starts to rotate, most of the developer present in the discharge path B is discharged through the discharge opening 66 without returning to the stirring bath 54 through the return opening 68. As a result, it becomes difficult to maintain an appropriate amount of developer in the developing bath 50. However, the return opening 68 of the developing apparatus 40A according to the first embodiment is disposed so as to be adjacent to the discharge opening 66. Hence, even if a large amount of developer flows into the positive direction side of the x-axis direction through the return opening 68, the developer returns to the circulation path A by the return opening 70. That is, an appropriate amount of developer can be maintained in the developing bath 50.

Second Embodiment

Figure 8:
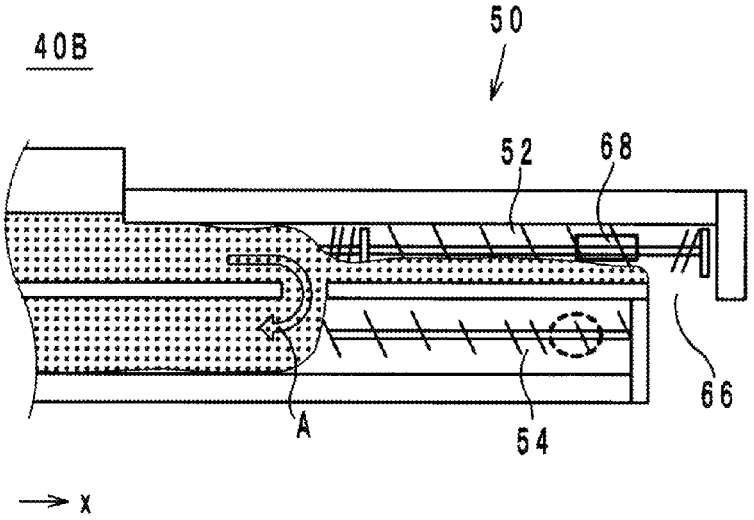
FIG. 8 is a cross-sectional view of a developing apparatus according to a second embodiment when viewed from a direction orthogonal to a central axis of a supply screw included in the developing apparatus.
Figure 9:
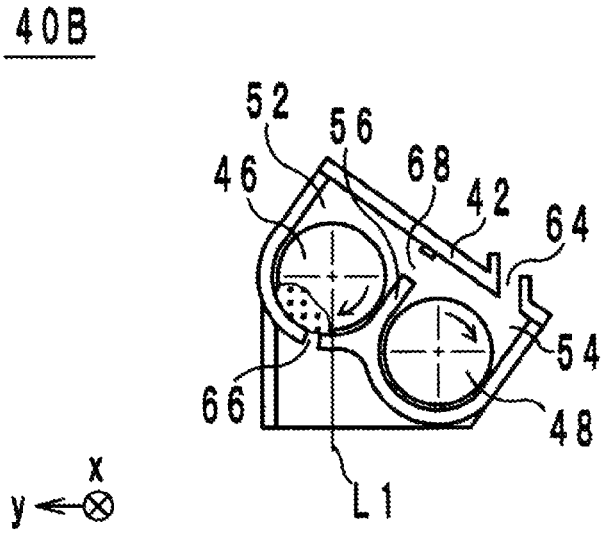
FIG. 9 is a cross-sectional view of the developing apparatus according to the second embodiment when viewed from a direction parallel to the central axis of the supply screw included in the developing apparatus.

See FIGS. 8 and 9

A developing apparatus 40B according to a second embodiment differs from a developing apparatus 40A according to the first embodiment in the disposition of a discharge opening 66, the disposition of a return opening 68, and the absence of a return opening 70. Specifically, as shown in FIG. 8, the developing apparatus 40B does not have a return opening 70. In addition, the discharge opening 66 of the developing apparatus 40B is provided at an end of a supply bath 52 on the positive direction side of an x-axis direction and at a substantially lower end in a vertical direction.

Furthermore, as shown in FIG. 9, the return opening 68 is provided on the negative direction side of a y-axis direction of a discharge path B, with a perpendicular line L1 passing through a central axis of a supply screw 46 being a boundary. In addition, the supply screw 46 rotates clockwise when viewed from the negative direction side of the x-axis direction. By this rotation, at normal times, developer is likely to be biased on the positive direction side (one side) of the y-axis direction. That is, the return opening 68 is provided in a separating wall 56 (a side wall of a discharge path) which is provided on the opposite side of the positive direction side of the y-axis direction where developer is likely to be biased at normal times.

The developing apparatus 40B configured in the above-described manner does not have a return opening 70 and thus is smaller in size in the x-axis direction than the developing apparatus 4 OA according to the first embodiment. In addition, the discharge opening 66 is provided at the end of the supply bath 52 on the positive direction side of the x-axis direction and at the lower end in the vertical direction. Thus, developer can be suppressed from being accumulated at the end of the supply bath 52 on the positive direction side of the x-axis direction.

In addition, the return opening 68 of the developing apparatus 40B is provided on the opposite side of the positive direction side of the y-axis direction where developer easily passes through at normal times. By this, at normal times, developer is prevented from returning to a circulation path A through the return opening 68, and an appropriate amount of developer is discharged through the discharge opening 66. Note that other configurations of the second embodiment are the same as those of the first embodiment. Therefore, in the second embodiment, description of those other than the disposition of the discharge opening 66, the disposition of the return opening 68, and the absence of a return opening 70 is as made in the first embodiment.

Third Embodiment

Figure 10:
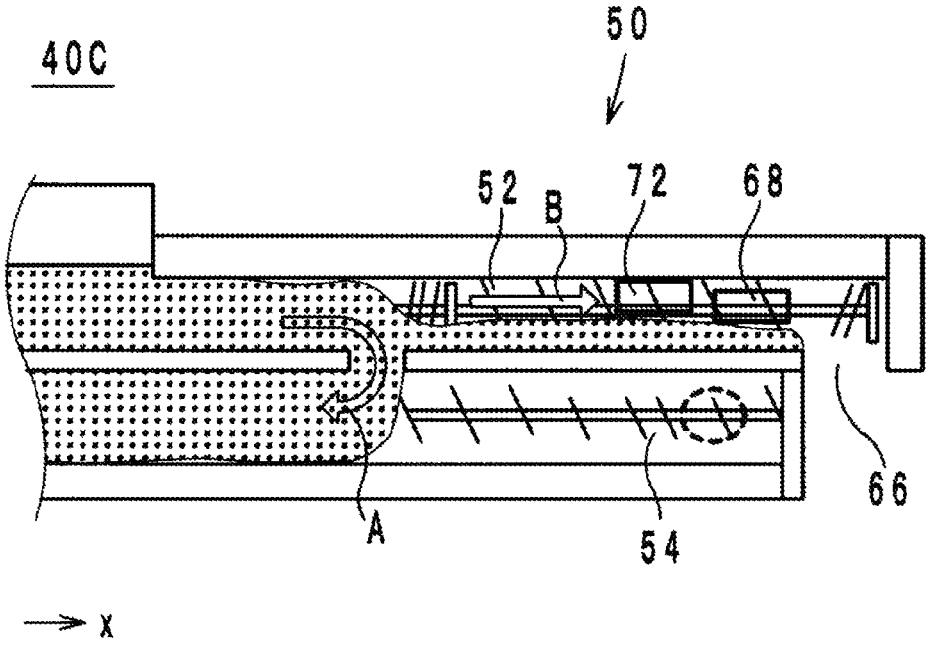
FIG. 10 is a cross-sectional view of a developing apparatus according to a third embodiment when viewed from a direction orthogonal to a central axis of a supply screw included in the developing apparatus.

See FIG. 10

A developing apparatus 40C according to a third embodiment differs from a developing apparatus 40B according to the second embodiment in that a return opening 72 is added. Specifically, as shown in FIG. 10, in the developing apparatus 40C, a discharge path B has the return opening 72 present more on the negative direction side of an x-axis direction than a return opening 68. That is, the return openings 68 and 72 are located more on the negative direction side of the x-axis direction than a discharge opening 66.

The developing apparatus 40C configured in the above-described manner has the plurality of return openings 68 and 72 provided more on the negative direction side of the x-axis direction than the discharge opening 66. Therefore, when the developing apparatus 40C is tilted more than expected and accordingly excess developer flows into the discharge path B, the developing apparatus 40C which is the third embodiment can return more developer to a circulation path A than the developing apparatus 40B which is the second embodiment. Note that other configurations of the third embodiment are the same as those of the second embodiment. Therefore, in the third embodiment, description of those other than the addition of the return opening 72 is as made in the second embodiment.

Fourth Embodiment

Figure 11:
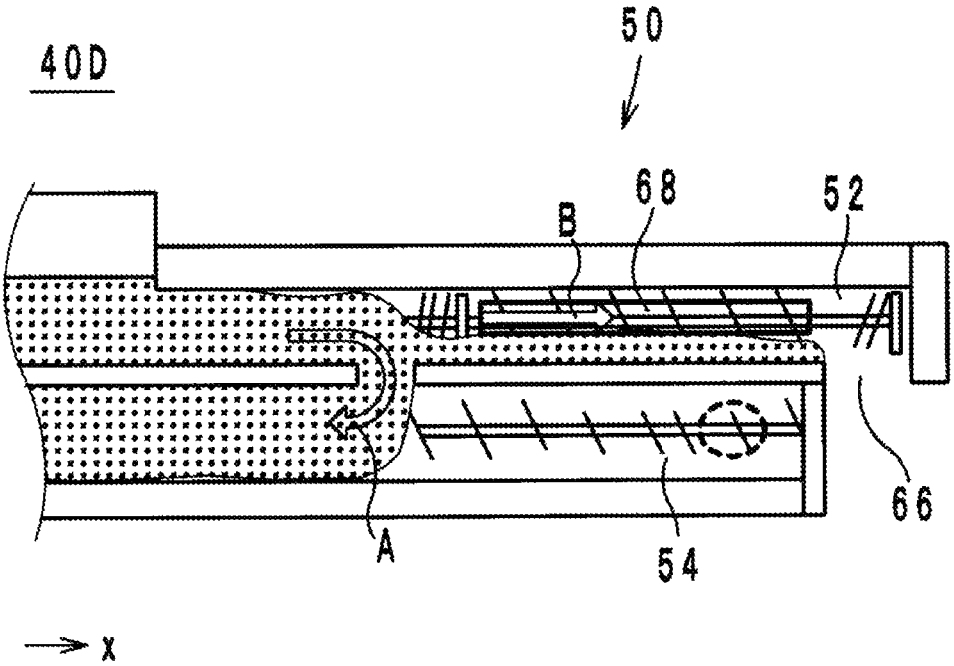
FIG. 11 is a cross-sectional view of a developing apparatus according to a fourth embodiment when viewed from a direction orthogonal to a central axis of a supply screw included in the developing apparatus.

See FIG. 11

A developing apparatus 40D according to a fourth embodiment differs from a developing apparatus 40B according to the second embodiment in the size of a return opening 68 and the rotation of a supply screw 46 at startup of the developing apparatus 40D. Specifically, as shown in FIG. 11, the developing apparatus 40D has the return opening 68 provided in substantially the entire area of a discharge path B, i.e., substantially the entire area ranging from a portion of a supply bath 52 where blades 46*a* of the supply screw 46 are located (a connecting portion between a circulation path and a discharge path) to a discharge opening 66. In addition, at startup of an image forming apparatus including the developing apparatus 40D, the developing apparatus 40D turns the supply screw 46 a quarter rotation in an opposite direction to a normal direction.

The size of the return opening 68 of the developing apparatus 40D configured in the above-described manner is larger than that of a return opening 68 of the developing apparatus 40B according to the second embodiment. Therefore, when the developing apparatus 40D is tilted more than expected and accordingly excess developer flows into the discharge path B, the developing apparatus 40D which is the fourth embodiment can return more developer to a circulation path A than the developing apparatus 40B which is the second embodiment. In addition to this, at startup of the image forming apparatus including the developing apparatus 40D, the developing apparatus 40D turns the supply screw 46 a quarter rotation in the opposite direction to the normal direction. By this, the developing apparatus 40D can more securely return developer to the circulation path A through the return opening 68. In addition, at startup of the developing apparatus 40D, by repeating reverse rotation and forward rotation, the developing apparatus 40D can further securely return developer to the circulation path A. Note that other configurations of the fourth embodiment are the same as those of the second embodiment. Therefore, in the fourth embodiment, description of those other than the size of the return opening 68 is as made in the second embodiment.

Other Embodiments

Developing apparatuses and image forming apparatuses according to the present invention are not limited to those of the above-described embodiments, and various changes may be made within the spirit and scope of the invention. For example, the shapes and numbers of the return openings are any shape and number. Furthermore, the embodiments may be combined together.

As described above, the present invention is useful for developing apparatuses and image forming apparatuses. Particularly, the present invention is excellent in that the invention can suppress the occurrence of uneven density in a developed image by maintaining an appropriate amount of developer in a developing bath.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A developing apparatus that develops an electrostatic latent image on an image supporting body, using developer including toner and carrier, the developing apparatus comprising:

a circulation path where the developer circulates;

a discharge path which is connected to the circulation path and through which some of the developer passes; and a first recycle path connected to the discharge path and allowing some of the developer flowing into the discharge path to return to the circulation path, wherein:

the discharge path is provided with:

a discharge opening for discharging the developer flowing into the discharge path;

a first return opening for connecting to the first recycle path; and a supply screw for transporting the developer flowing into the discharge path, the first return opening is located on an upper side in a vertical direction with respect to the discharge opening and located on an upstream side in a pass-through direction of the developer flowing into the discharge path, and the developer transported within the discharge path is biased to one side of the discharge path by rotation of the supply screw, and the first return opening is provided in a side wall that is located opposite to the one side of the discharge path in a direction orthogonal to an axis of the supply screw.

2. The developing apparatus according to claim 1, further comprising:

a second recycle path connected to the discharge path and allowing some of the developer flowing into the discharge path to return to the circulation path, wherein:

the discharge path is provided with a second return opening for connecting to the second recycle path, and the second return opening is located on a downstream side in the pass-through direction of the developer flowing into the discharge path, with respect to the discharge opening.

3. The developing apparatus according to claim 2, wherein the second return opening is located on a lower side in the vertical direction with respect to the discharge opening.

4. The developing apparatus according to claim 1, wherein a plurality of first return openings are provided in the pass-through direction of the developer flowing into the discharge path.

5. The developing apparatus according to claim 1, wherein the first return opening is provided over substantially an entire area ranging from a connecting portion between the circulation path and the discharge path to the discharge opening.

6. The developing apparatus according to claim 1, wherein the first return opening is disposed so as to be adjacent to the discharge opening.

7. The developing apparatus according to claim 1, wherein the developing apparatus is included in an image forming apparatus, and at startup of the image forming apparatus, a supply screw temporarily rotates in an opposite direction to a normal rotation direction of the supply screw.

8. An image forming apparatus comprising the developing apparatus according to claim 1.

9. A developing apparatus that develops an electrostatic latent image on an image supporting body, using developer including toner and carrier, the developing apparatus comprising:

a circulation path where the developer circulates;

a discharge path which is connected to the circulation path and through which some of the developer passes; and a first recycle path connected to the discharge path and allowing some of the developer flowing into the discharge path to return to the circulation path, wherein:

the discharge path is provided with:

a discharge opening for discharging the developer flowing into the discharge path; and a first return opening for connecting to the first recycle path, the first return opening is located on an upper side in a vertical direction with respect to the discharge opening and located on an upstream side in a pass-through direction of the developer flowing into the discharge path, and the first return opening is provided over substantially an entire area ranging from a connecting portion between the circulation path and the discharge path to the discharge opening.

10. The developing apparatus according to claim 9, further comprising:

a second recycle path connected to the discharge path and allowing some of the developer flowing into the discharge path to return to the circulation path, wherein:

the discharge path is provided with a second return opening for connecting to the second recycle path, and the second return opening is located on a downstream side in the pass-through direction of the developer flowing into the discharge path, with respect to the discharge opening.

11. The developing apparatus according to claim 10, wherein the second return opening is located on a lower side in the vertical direction with respect to the discharge opening.

12. The developing apparatus according to claim 9, wherein a plurality of first return openings are provided in the pass-through direction of the developer flowing into the discharge path.

13. The developing apparatus according to claim 9, wherein the first return opening is disposed so as to be adjacent to the discharge opening.

14. The developing apparatus according to claim 9, wherein the developing apparatus is included in an image forming apparatus, and at startup of the image forming apparatus, a supply screw temporarily rotates in an opposite direction to a normal rotation direction of the supply screw.

15. An image forming apparatus comprising the developing apparatus according to claim 9.

* * * * *